United States Patent [19]

Pomonik

[11] 4,320,545

[45] Mar. 23, 1982

[54] EASILY REMOVABLE FLUID SWIVEL FOR SALM BUOY INSTALLATION

[75] Inventor: George M. Pomonik, Van Nuys, Calif.

[73] Assignee: Amtel, Inc., Providence, R.I.

[21] Appl. No.: 953,710

[22] Filed: Oct. 23, 1978

[51] Int. Cl.[3] ..... B63B 21/52; B63B 51/02

[52] U.S. Cl. ..... 441/4; 114/230; 114/257; 285/325; 405/224

[58] Field of Search ..... 285/325, 31, 15, 16, 285/17, 114; 166/350, 359, 367; 405/224, 226, 202; 138/97; 114/230, 257; 9/8 P

[56] References Cited

U.S. PATENT DOCUMENTS

| | | | |
|---|---|---|---|
| 1,300,380 | 4/1919 | Griffin | 285/16 |
| 2,196,622 | 4/1940 | Bean | 285/114 |
| 2,651,329 | 9/1953 | Fowler | 138/97 |
| 3,070,019 | 12/1962 | Sies | 285/114 |
| 3,385,314 | 5/1968 | Thompson | 138/97 |
| 3,501,173 | 3/1970 | Petersen | 285/114 |
| 3,614,869 | 10/1971 | Flory | 114/230 |
| 3,641,602 | 2/1972 | Flory | 9/8 P |
| 3,844,240 | 10/1974 | Whitehouse | 114/230 |
| 3,907,374 | 9/1975 | Steele | 285/31 |
| 3,982,727 | 9/1976 | Nelimarkka | 285/325 |
| 4,069,529 | 1/1978 | van Heijst | 114/230 |
| 4,138,751 | 2/1979 | Kentosh | 9/8 P |

*Primary Examiner*—Trygve M. Blix
*Assistant Examiner*—D. W. Keen
*Attorney, Agent, or Firm*—Freilich, Hornbaker, Wasserman, Rosen & Fernandez

[57] ABSTRACT

A single anchor leg mooring (SALM) installation which enables replacement of a product distribution unit (PDU) without removal of the upper buoyancy structure, including a plurality of arms that can extend around the PDU to connect the buoyancy structure lying above the PDU with a lower structure that lies below the PDU and extends to the sea floor. The transference of oil or other cargo can continue during the replacement of a malfunctioning PDU, by providing a pair of PDUs and a pair of valves for bypassing one of them which is to be removed.

7 Claims, 7 Drawing Figures

FIG. 1
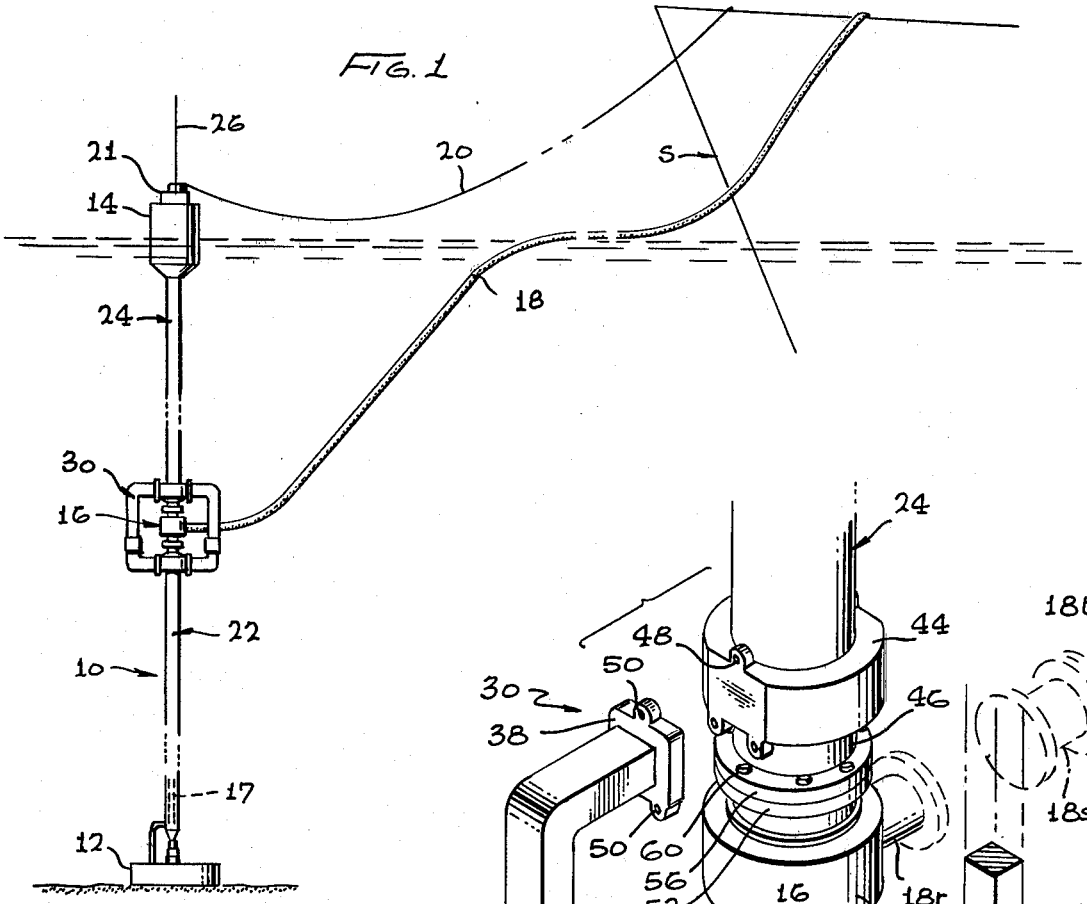
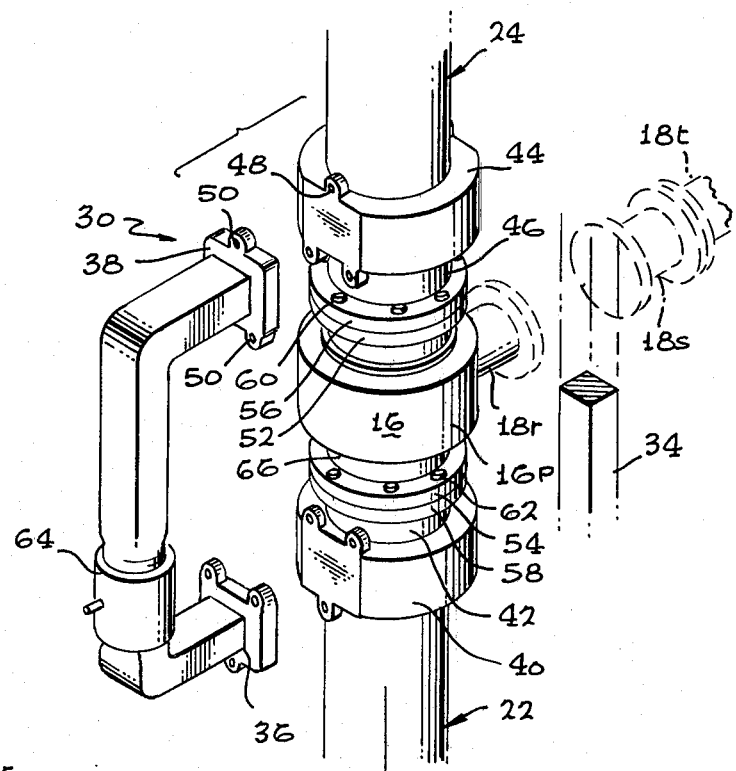
FIG. 2
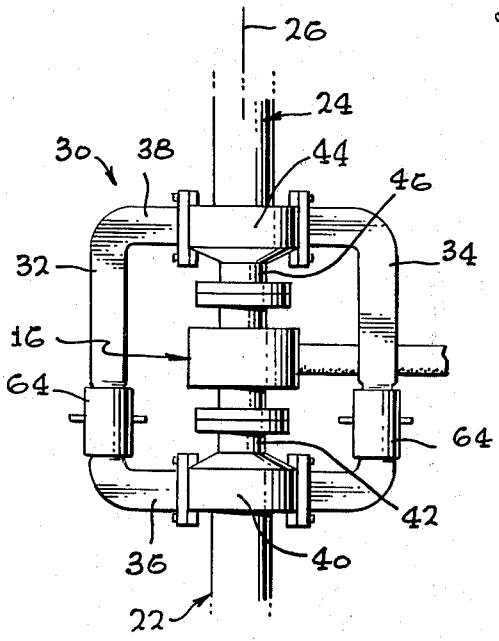
FIG. 3

EASILY REMOVABLE FLUID SWIVEL FOR SALM BUOY INSTALLATION

BACKGROUND OF THE INVENTION

A SALM buoy installation can include a buoyant riser such as a tall column extending from the sea floor to the sea surface, and having a swivel unit, or product distribution unit (PDU) therealong. A mooring line or hawser can extend from a ship to the upper portion of the column which lies above the PDU, while underwater hoses can lead from the PDU to the ship to carry oil or other cargo between them. The PDU can rotate about the vertical axis of the column to follow a drifting ship. The PDU is subject to wear, and occasionally must be replaced. This has typically necessitated the removal of the entire upper column portion lying above the PDU, and since this structure is massive and highly buoyant it requires considerable time and expense to replace the PDU. Although divers can reach the PDU which is typically located a moderate distance under water, and could even remove it from the rest of the column structure, the removal of the PDU which lies coaxial with the column normally has left the upper buoyancy structure free to move about, and its large size and buoyancy makes it difficult to handle. A SALM buoy installation which enabled the replacement of a PDU located coaxially with and along a riser such as a column, without requiring the freeing of the upper buoyancy structure portion of the column, would facilitate the replacement of damaged PDUs. In many situations, it would be even more desirable if cargo transfer could continue during the period when a malfunctioning PDU of the above-described type was being replaced.

SUMMARY OF THE INVENTION

In accordance with one embodiment of the present invention, a single anchor leg mooring (SALM) buoy installation is provided, of the type which includes a product distribution unit (PDU) located along the axis of the SALM anchor leg between an upper buoyancy structure and a lower structure thereof, which facilitates replacement of the PDU. This is accomplished by the use of a tension transmitting device extending to one side of the axis of the anchor leg, and having upper and lower ends respectively coupled to the upper and lower structures to hold the upper buoyancy structure in position. Accordingly, mooring forces do not have to pass through the middle of the PDU, but instead can pass through the tension transmitting device that bypasses the PDU.

In one installation, the tension trasmitting device includes a group of arms with lower ends rotatably connected to the lower surface, and with one of the arms coupled to the PDU through the hose structure that leads from the PDU to rotate with the hose about the SALM installation. The arms can each include an adjustment mechanism that permits slight elongation and shortening, to facilitate the installing of a new PDU. The arms can be temporary structures designed for installation just prior to replacement of a PDU, and removable after a new PDU has been emplaced, or can be permanently installed. In one structure where the arms are permanently installed, tension forces are not transmitted through the center of the PDU, but instead a gap is left between the top of the PDU and the upper buoyancy structure, to facilitate replacement of the PDU. In another installation, a pair of PDUs and a pair of valves are provided, which enable the bypassing of one of the PDUs when the other one is being replaced, so that the transference of cargo can continue during the replacement of a defective PDU.

The novel features of the invention are set forth with particularity in the appended claims. The invention will be best understood from the following description when read in conjunction with the accompanying drawings.

BRIEF DESCRIPTION OF THE DRAWINGS

FIG. 1 is a side elevation view of a column type SALM buoy installation, constructed in accordance with one embodiment of the invention.

FIG. 2 is a more detailed view of a portion of the installation of FIG. 1.

FIG. 3 is a partial exploded perspective view of the installation of FIG. 2.

DESCRIPTION OF THE PREFERRED EMBODIMENTS

Figure 4:
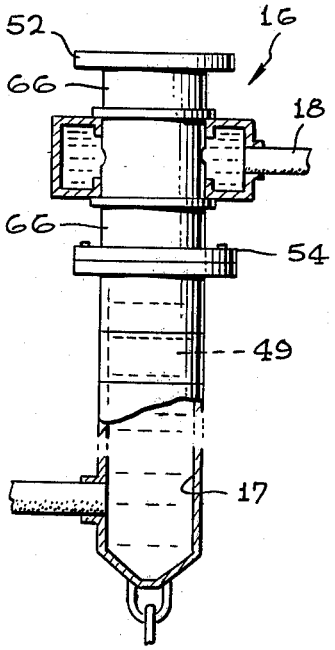
FIG. 4 is a sectional side view of a portion of the installation of FIG. 2.

FIG. 1 illustrates a buoy installation of the single point mooring type, which includes a column type buoyant riser structure or riser 10 extending from a base 12 at the sea floor to a buoy 14 at the sea surface. The riser includes a swivel unit or produce distribution unit (PDU) 16 lying beneath the sea surface, for connection through a fluid conduit or hose structure 18 to a ship S that is moored through a mooring line or hawser 20 to a swivel joint 21 on the buoy. The riser structure includes a lower structure 22 below the PDU 16 and having a fluid conduit 17 extending therealong, and an upper structure 24 including the buoy 14 that lies above the PDU. The lower structure 22 may be mounted to the base 12 so it cannot turn by more than a limited amount about a vertical axis 26, in addition to tilting to the side. Although it may not matter whether or not the upper structure 24 can rotate without limit about the vertical axis, the rotatable portion of the PDU 16 must rotate without limit about a vertical axis 26 to follow the ship as it drifts about the buoy.

The PDU 16 is a device that occasionally requires maintenance or replacement. Heretofore, replacement of the PDU necessitated removal of the upper structure 24, which then had to be kept under control against drifting away or crashing into anything, while a new PDU was installed. The upper structure 24 is normally massive and very highly buoyant, and once it is freed from the constraint of the lower column structure 22, handling is difficult, so that replacement of a PDU required considerable time and expense. The construction of prior art riser structures typically followed the straightforward design approach of utilizing a series of connected tension elements extending along the axis 26 of the riser from the sea base 12 to the buoy 14, and with the PDU mounted along this tension structure.

In accordance with the present invention, the riser 10 is constructed so that removal of the PDU 16 does not require freeing of the upper structure 24 from the lower structure 22. As shown in FIG. 2, this is accomplished by providing a tension transmitting device 30 that extends a distance from the vertical axis of rotation 26, to extend around the PDU 16 which lies coaxial with the axis 26. The tension transmitting device 30 includes a plurality of arms, such as a pair of arms 32, 34 having lower ends 36 coupled to the lower structure 22 and upper ends 38 coupled to the upper structure 24 and a middle portion extending around the PDU 16.

In one embodiment of the invention shown in FIGS. 1–4, the arms 32, 34 are normally not attached to the riser but are utilized only during the replacement of the PDU 16. The lower structure 22 includes a bearing 40 which can rotate about a rigid pipe portion 42 of the lower structure. The upper structure includes a collar 44 mounted on a pipe portion 46 of the upper structure. Both the bearing 40 and collar 44 have fastener-receiving holes 48 (FIG. 3) that enable fastening by bolts or other fasteners to the ends 36, 38 of each arm such as 32.

In order to replace a malfunctioning PDU, a diver first attaches the two arms 32, 34. This can be accomplished by first fastening the upper ends 38 of the arms to the collar 44 of the upper structure, as by utilizing bolt-like fasteners that project through holes 50 in the arm and corresponding holes 48 formed in the collar. Prior to tightening the fasteners, the bearing 40 on the lower column structure is turned so that the holes 48 on the bearing 40 lie opposite the holes on the lower arm end 36, and fasteners are attached. The fasteners at the opposite ends of each arm are then tightened. Thus, the upper and lower structures are securely held together in a connection that bypasses the axis of the riser at the PDU 16. The PDU 16 is then ready for replacement. A shutoff valve 49 (FIG. 4) located along the lower structure is closed prior to removing the PDU.

The PDU 16 has upper and lower flanges 52, 54 that are connected to corresponding flanges 56, 58 at the upper and lower structures. The PDU can be removed by first removing groups of bolts 60, 62 that fasten the upper and lower flanges of the PDU in place. Then, the upper structure 24 must be lifted slightly. Such lifting can be accomplished by turning a nut 64 on each arm to increase the effective lengths of the arms so as to provide room for removing the PDU. Of course, hydraulic or other adjustment mechanisms can be utilized to slightly separate and bring together the upper and lower structures. After the PDU 16 is removed and another put in its place, the nut actuators 64 are turned to bring the upper and lower structures close together so their flanges rest against the flanges 52, 54 of the new PDU. The bolts 60, 62 then can be reinstalled on the flanges to complete the PDU installation. If desired, the arms 32, 34 can then be removed, with tension forces transmitted between the lower and upper members through a pipe 66 of the PDU which forms the stationary portion of the PDU which is stationary to the extent that it does not rotate without limit about a vertical axis.

Where a rotatable bearing 40 is utilized to connect the arms to the lower structure 22, the arms can rotate with the outer portion 16P of the PDU, so that the arms do not interfere with normal operation of the PDU. Accordingly, the arms 32, 34 can be left indefinitely in place and become a permanent part of the installation. In fact, the arms can be useful in aiding the turning of the rotatable outer portion 16P of the PDU, the minimize stresses on the hose structure. In a permanent installation of the tension transmitting device 30, it is desirable to securely connect one of the arms to the hose structure 18. This can be accomplished as shown in FIG. 3, by utilizing a hose structure 18 that includes a short rigid pipe **18*r* connected to the rotatable portion of the PDU, another short pipe 18*s* fixed to one of the arms 34, and a hose 18*t* extending to the ship. The hose structure portions 18*r*, 18*s*, 18*t*** have flanges that enable them to be connected in series.

In a temporary installation, a collar at 44 can be utilized which does not include a rotatable bearing, so that the upper structure 24 will rotate with PDU. A collar also could be used instead of the rotatable bearing at 40, in a temporary installation, except that a rotatable bearing at 40 is useful in aligning the flat surfaces on the upper and lower collar or bearing couplings 40, 44 to enable installation of the arms 32, 34. In a permanent installation, it can be advantageous to utilize a bearing at 44, so that the large mass of the upper column structure does not have to be turned along with the PDU 16 when the ship S drifts about the column. Also, although two arms 32, 34, or possibly only one arm, may be sufficient as the tension transmitting device in a temporary installation, three or four arms may be desirable in a permanent installation to more reliably transmit bending forces in any direction when the riser is pulled to any side.

Figure 5:
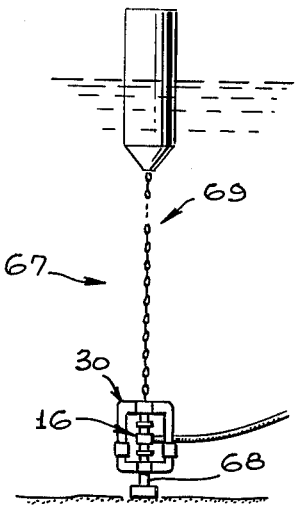
FIG. 5 is a side elevation view of a chain type SALM buoy installation which utilizes a tension transmitting device similar to that of FIG. 1.

Although a column type buoy installation may be utilized which has column-like upper and lower structures, it may be noted that chain SALMs are also available, such as in the installation 67 shown in FIG. 5. In this figure the lower riser portion or structure 68 lying below the PDU 16 is fixed to the base on the sea floor, while the upper riser portion or structure 69 includes a long chain with a buoy at the top. The same tension transmitting device 30 that includes a plurality of arms, can be utilized to hold the upper structure to the lower one, while the PDU 16 is being replaced.

Figure 6:
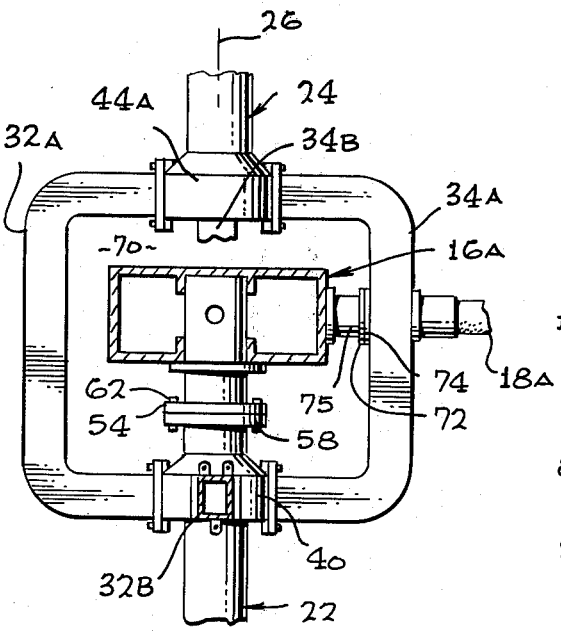
FIG. 6 is a partially sectional side view of a buoy installation constructed in accordance with another embodiment of the invention.

FIG. 6 illustrates a portion of a buoy installation similar to that of FIG. 1, but wherein a middle portion of the riser that includes the PDU is constructed to further facilitate replacement of the PDU 16A. This is accomplished by utilizing a group of four arms 32A, 34A, 32B, and 34B that are permanently attached between a bearing 40 near the top of the lower structure 22 that permits the arms to rotate about the vertical axis, and a bearing 44A near the bottom of the upper column structure. The PDU 16A has only one mounting flange 54 which mounts to the lower structure, and is spaced from the upper structure 24. A gap 70 is left between the upper column structure 24 and the PDU 16A. One of the arms 34A is utilized to support the hose structure 18A leading from the PDU and to aid in turning it as a ship drifts around the installation. This is accomplished by coupling the hose structure 18A to the arm 34A so that they move together about the vertical axis 26.

The PDU 16A can be removed by removing several bolts 62 that connect its flange 54 to the flange 58 at the top of the lower structure 22, and by also detaching a pair of flanges 72, 74 that connect a pipe 75 of the hose structure that extends from the PDU outlet to the arm 34A. The PDU 16A then can be lifted upwardly slightly into the gap 70 and replaced by another PDU. All during the replacement process, the upper structure 24 continues to be securely held in place with respect to the lower structure 22.

Figure 7:
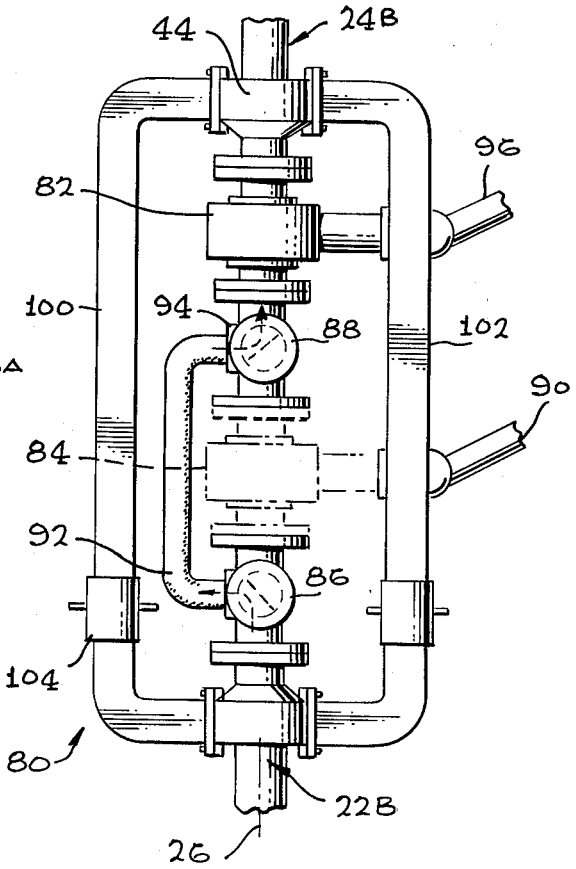
FIG. 7 is a side elevation view of a buoy installation constructed in accordance with another embodiment of the invention.

In many situations it is important to enable the delivery of oil, gas, slurry, or other cargo through the buoy installation during the replacement of a defective PDU. FIG. 7 illustrates a riser 80 which includes two PDUs 82, 84 that can be utilized interchangeably, so that when one of them such as 84 is being replaced, the other one 82 can transfer cargo. The riser includes a pair of valves 86, 88 that enable bypassing of one of the PDUs 84 when it is being replaced, and the PDUs 82, 84 and valves 86, 88 are arranged in a stack. Normally, oil flowing upwardly along the bottom column structure 22B flows first through the lower valve 86, and then into the PDU 84 for transference through a hose 90 to a ship. When PDU 84 is operating, the outer PDU 82 may lie unused.

In order to replace the PDU 84, a bypassing conduit such as a hose 92 is connected between the valves 86 and 88 to bypass the PDU 84. The valve 86 is then operated to deliver oil passing therethrough into the hose 92, while the other valve 88 is operated to connect oil entering its input port 94 to the PDU 82, for delivery of the oil through another hose 96 to the ship. Thus, the cargo is delivered through the alternate PDU 82 so that the other PDU 84 can be removed in the same manner as the PDU of FIG. 2. A pair of arms 100, 102 connected the lower and upper structures 22B, 24B to transfer the tension and other loads from the upper structure to the lower one so as to bypass the PDU 84. Each of the arms can be provided with an actuator 104 similar to the nut 64 of FIG. 5, to enable separation of the valves 86, 88 to facilitate removal of the PDU 84, and to bring the valve assemblies together in the clamping of a replacement PDU. In a similar manner, the alternate PDU 82 can be removed by merely operating the valve 86 to deliver its cargo through the primary PDU 84. It is possible to attach the hose 92 only when the valves 86, 88 are utilized to bypass the PDU 84, so as to minimize possible damage to the hose when it is not utilized. Of course, it is possible to provide a valve interconnecting the hoses 90 and 96, so that a single hose can be utilized to carry oil to or from either of the PDUs 82 or 84. It may be noted that a pair of on-off, or shutoff valves may be utilized in place of each of the valves 86, 88 to provide a more reliable control of flow to minimize the possibility of leakage. Also, a gap may be left above the upper PDU 82 to facilitate replacement, and more than two PDUs may be provided to enable the uninterrupted flow of two or more fluids.

Thus, the invention provides a single point mooring buoy installation of the type which utilizes a product distribution unit (PDU) beneath an upper buoyancy structure of a riser, which facilitates replacement of the PDU by allowing such replacement to occur without detaching the upper buoyancy structure from the rest of the riser. This is accomplished by utilizing a tension transmitting device such as a plurality of largely U-shaped arms, which extend around the PDU to one side of the vertical axis of rotation of the PDU, to connect the upper and lower structures together. The arms can be utilized for temporary connections during the replacement of a PDU or can be permanently emplaced. The PDU structure can be constructed to enable the continuance of cargo transfer during the replacement of a defective PDU, by providing a pair of PDUs and a valving structure to use them alternately, and by providing a tension transmitting means to transfer the load of the upper buoyancy structure around the area where the PDU may be removed. Thus, where it has often required perhaps a week of time and a large expense to remove a prior art PDU, where the upper buoyancy structure also had to be removed, the replacement can occur in a shorter time such as perhaps one day. Furthermore, it is possible to continue the delivery of oil during the replacement period.

Although particular embodiments of the invention have been described and illustrated herein, it is recognized that modifications and variations may readily occur to those skilled in the art and consequently, it is intended that the claims be interpreted to cover such modifications and equivalents.

The embodiments of the invention in which an exclusive property or privilege is claimed are defined as follows:

1. In a buoy installation of a type which includes an upper structure and a lower structure having a fluid conduit, the improvement of a product distribution assembly comprising:

first and second product distribution units, each having a largely stationary portion and a rotatable portion;

first and second valve means for controlling the flow of fluid therethrough;

said units and valve means connected in a stack, with said first unit above said first valve means, said second valve means above said first unit, and said second unit above said second valve means;

hose means for connecting said first valve means to said second valve means, said first valve means operable to direct fluid between said lower structure conduit and either said first unit or said hose means; and a tension transmitting device extending beside said product distribution units and connecting said upper and lower structures to hold said upper structure in place.

2. A method for replacing a first product distribution unit that lies between the upper and lower structures of the riser of a buoy installation, comprising:

establishing a second product distribution unit above, and a valve below, the first product distribution unit, so the valve normally connects a conduit in the lower column structure to the first unit;

establishing a tension transmitting means to connect the upper and lower structures;

establishing a bypassing conduit to connect the valve to the second unit;

operating the valve to connect the lower structure conduit to the bypassing conduit instead of the first unit; and removing the first unit.

3. In a buoy installation which includes a buoyant riser extending upwardly from the sea bottom, and a product distribution unit located along the riser between lower and upper structures of the riser, and wherein the product distribution unit has a rotatable portion rotatable about a substantially vertical axis, and the riser includes a middle portion extending vertically within the rotatable portion of the product distribution unit and connecting the lower and upper structures of the riser, the improvements of means for temporarily holding the upper structure in place during replacement of a damaged or worn product distribution unit comprising:

means for detachably connecting said middle portion of said riser to said riser structures;

a tension transmitting device extending to the side of said axis at a location beside said product distribution unit, and having upper and lower ends; and means for temporarily fastening the upper and lower ends of said tension device respectively to said upper and lower riser structures.

4. A method for replacing a product distribution unit that lies between and is fastened to both the upper and lower structures of the riser of a buoy installation whose riser extends along a largely vertical axis comprising:

attaching the ends of a plurality of tension transmitting devices, respectively to the lower end of said upper structure and to the upper end of said lower structure, so that said devices lie beside the axis of said riser, to support the upper structure to the lower one while the product distribution unit remains in place along said axis; and removing the product distribution unit by detaching it from both of said structures, later installing a product distribution unit in the place of the removed unit while said tension devices are attached to said riser structures, and detaching the ends of said tension device from said riser structure.

5. The method described in claim 4 wherein:

at least one of said tension devices has an actuator which is operable to increase and decrease the distance between the ends of the device, said step of removing includes operating said actuator to increase the distance between the ends of the device, and said step of later installing a unit includes operating said actuator to decrease the distance between the ends of the device.

6. In a buoy installation which includes a buoyant riser extending upwardly from the sea bottom, and a first product distribution unit located along the riser between lower and upper structures of the riser, and wherein the product distribution unit has a rotatable portion rotatable about a substantially vertical axis, the improvement comprising:

a tension transmitting device extending to the side of said axis at a location beside said first product distribution unit, and having upper and lower ends respectively coupled to said upper and lower structures;

an upper product distribution unit lying above said first mentioned unit and having a stationary and a rotatable portion;

a lower valve located below said first product distribution unit; and an upper valve located between said first and upper product distribution units, and connected to said upper unit, whereby to enable use of the upper unit by using a hose or other conduit to connect the upper and lower valves, so that fluid flow can continue while the first mentioned unit is removed.

7. A buoy installation for use in a sea, comprising:

a buoyant riser which includes a lower structure extending upwardly form the sea bottom, and a buoyant upper structure extending upwardly from the lower structure;

a product distribution unit located along said riser between said lower and upper structures, said unit including an inner stationary portion connecting said lower and upper structures to transmit forces between them, and also including an annular rotatable portion surrounding said inner portion and rotatable thereabout while in fluid communication with said inner portion; and a tension transmitting device which can extend to the side of said product distribution unit, and having upper and lower ends which can respectively couple to said upper and lower riser structures;

said inner stationary portion of said unit being detachably connected to said lower and upper riser structures to permit removal of the unit, and said tension transmitting device including means at either of its ends for temporarily fastening to a corresponding one of said riser structures to hold them together when the product distribution unit is removed.

* * * * *